US005752135A

United States Patent [19]

Coffey et al.

[11] Patent Number: 5,752,135

[45] Date of Patent: May 12, 1998

[54] DOOR OPERATED CHARGE MEMBER POSITIONING

[75] Inventors: Johnnie A. Coffey, Winchester; Larry Steven Foster, Lexington; Paul Douglas Horrall, Lexington; John Randolph McIntyre, Lexington, all of Ky.

[73] Assignee: Lexmark International, Inc., Lexington, Ky.

[21] Appl. No.: 853,994

[22] Filed: May 9, 1997

[51] Int. Cl.[6] ..... G03G 21/18

[52] U.S. Cl. ..... 399/115; 399/174

[58] Field of Search ..... 399/107, 110, 399/111, 115, 168, 174, 175, 176

[56] References Cited

U.S. PATENT DOCUMENTS 4,941,015 7/1990 Komai et al. .
5,095,335 3/1992 Watanabe et al. .
5,365,315 11/1994 Baker et al. .
5,465,136 11/1995 Watanabe .
5,526,097 6/1996 Ream .
5,596,395 1/1997 Sawamura et al. ..... 399/168
5,629,755 5/1997 Ohtsuka ..... 399/176
5,638,158 6/1997 Sanpe et al. ..... 399/115 X

*Primary Examiner*—Sandra L. Brase
*Attorney, Agent, or Firm*—John A. Brady

[57] ABSTRACT

The door (3) of a laser printer (1) is pivoted to the frame (1*c*) of the printer by a pin (21) of hinge (19). When the door is shut, link (33) is rotatably connected to the hinge at a location above the pin. Link 33 has an elongated slot (33*a*) at its end opposite the hinge in which a pin (51) does not encounter the edge of the slot when the door is closed. Spring (31) therefore rotates U shaped link 11 around its pivot point (15) to the frame to bring charge roller (9) into contact with photoconductor drum (5). When the door is manually opened, spring 31 provides an upward force, link 33 is moved forward where the slot engages pin 51, which pivots both link 13 and door 3 upward. Force of the charge roller against the drum is by the spring as the only active element, thereby providing a controlled force.

2 Claims, 5 Drawing Sheets

DOOR OPERATED CHARGE MEMBER POSITIONING

TECHNICAL FIELD

This invention relates to imaging machines in which a contact charging member is moved into contact with a photosensitive member by mechanisms operated by door opening and closing.

BACKGROUND OF THE INVENTION

In a laser imaging device, such as a printer or copier, employing contact charging, the charging member may be a permanent part of the imaging device while the photosensitive member is part of a removable toner cartridge. To remove the toner cartridge, the charging member must move out of contact with the photosensitive member. Conversely, when a cartridge is inserted in the machine, the charging member must be moved into contact with photoconductive member.

A system of this general nature is disclosed in U.S. Pat. No. 5,526,097 to Ream, which is assigned to the assignee of this invention. This invention employs a novel design in which springs on opposite sides of the mechanism are the sole source of force on the charging member when a door of the device is closed and the same springs provides a force which contributes to holding the door up after it is opened.

DISCLOSURE OF THE INVENTION

This invention employs a first link rotatably attached to the machine door hinge. The opposite end of the first link has a loose lateral fit with a pin to a link carrying the charging member. A second link carrying the charging member is rotatably connected to the frame within the machine. A spring or other resilient member is connected by one end to the second link and by the opposite end to the door hinge above the pivot point of that hinge.

When the door is closed, the loose fit is in a noncontact position, so the spring is the only element actively forcing the charging member downward in the contact with a photosensitive member, thereby providing a controlled force. When the door is opened, the link from the hinge is moved into contact with the pin and this causes the spring to contribute to holding the door up.

In the specific embodiment disclosed the second link, which carries the charging member, is generally U shaped. Forces on the second link from the side near the charging member, such as from a shutter pushed open, are directed through the pivot point on the frame and are therefore neutralized.

BRIEF DESCRIPTION OF THE DRAWING

The details of this invention will be described in connection with the accompanying drawing, in which.

BEST MODE FOR CARRYING OUT THE INVENTION

Figure 1:
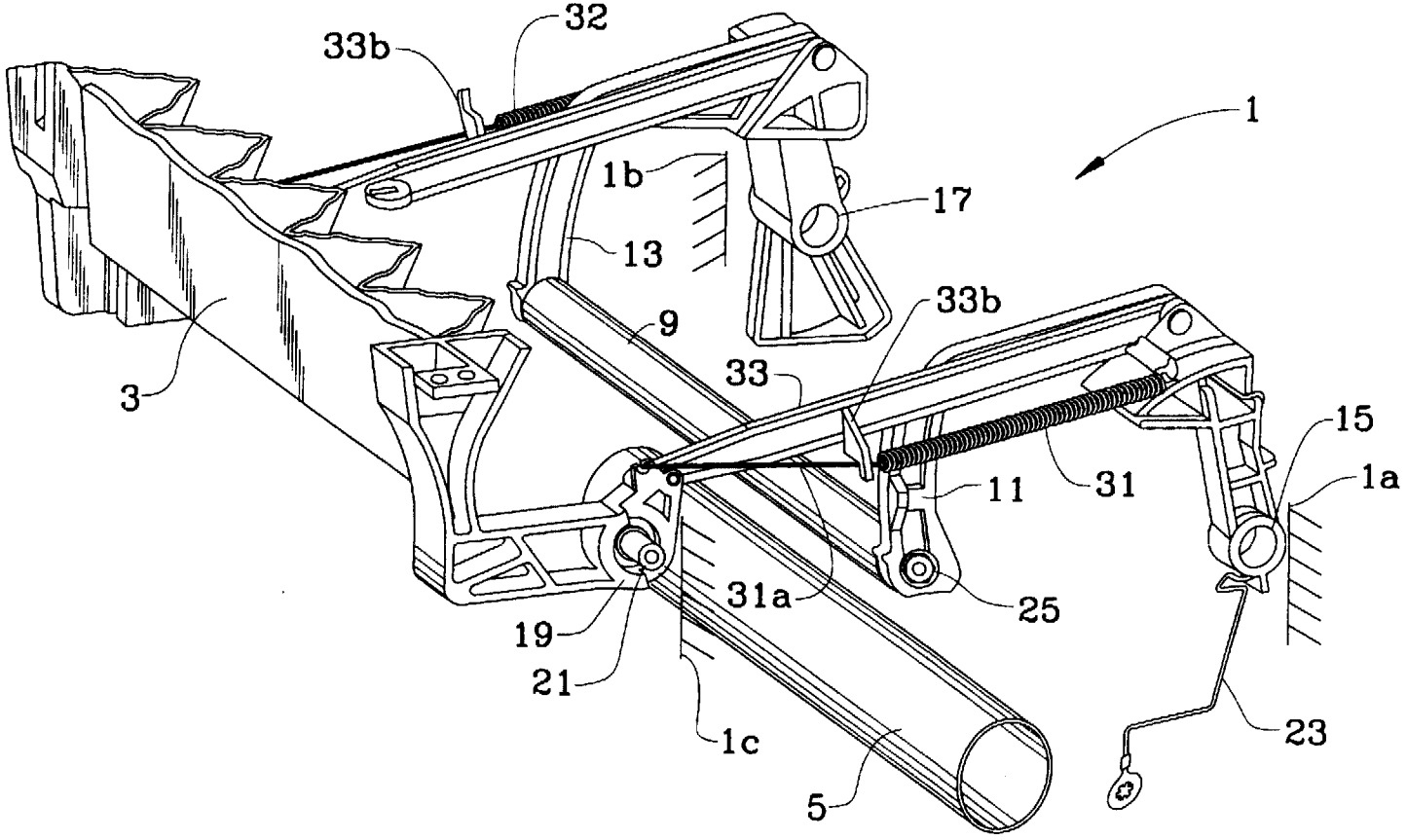
FIG. 1 is a top perspective view of significant elements employed in this invention.

FIG. 1 illustrates a laser printer 1, having two frame elements 1*a*, 1*b*, illustrated symbolically on each side of printer 1. Printer 1 has a door 3 rotatable upward for access into printer 1.

Figure 2:
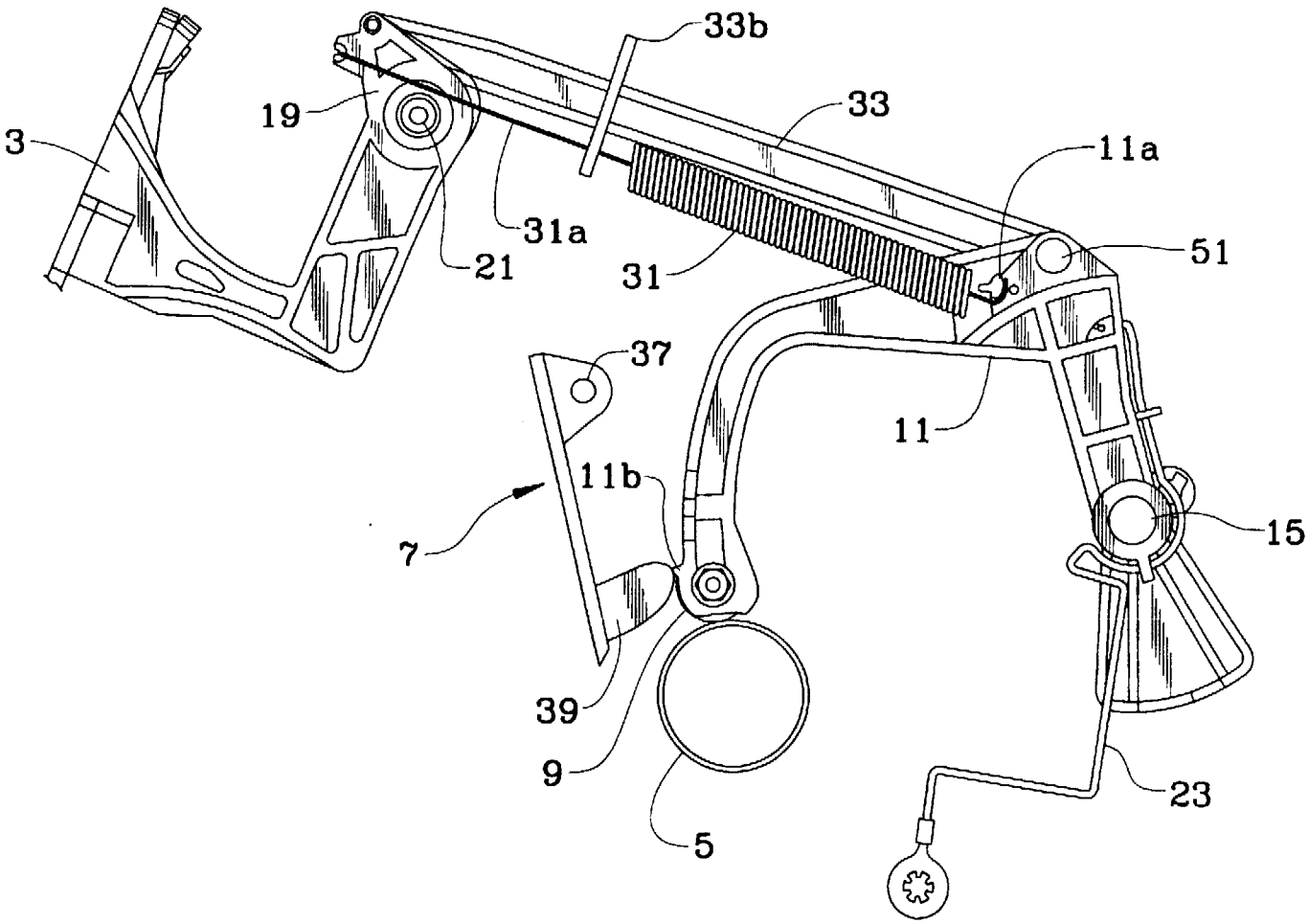
FIG. 2 is a side view from the right of FIG. 1 with the printer door closed, which also shows a shutter moved by this mechanism.

Door 3 may be opened for various purposes, such as to investigate paper jams, and is routinely opened to insert and remove a cartridge which includes photoconductor drum 5 illustrated in its installed position. Drum 5 is part of a cartridge which contains toner and toner applicator members not related to this invention and therefore not shown. As illustrated in FIG. 2 and as generally disclosed in the foregoing U.S. Pat. No. 5,526,097, the cartridge has a top shutter 7 (FIG. 2) which is pushed downward as will be described.

A charge roller 9 is mounted for rotation by one end of link 11 and one end of link 13 (FIG. 1). Links 11 and 13 are generally in the shape of the capital letter U and are rotatably mounted at their sockets 15 and 17 to the frame members 1*a*, 1*b* respectively by pins (not shown).

Similarly, door 3 has a hinge element 19 having a pin 21 mounted for rotation in frame 1*c* of printer 1. A mirror image, essentially-similar hinge and pin mounted in the frame of printer 1 is on the other side of door 3 (not shown).

Charge roller 9 has an electrical potential applied to it through wire 23 which is threaded through link 11 to reach a metal bushing 25 on the end of charge roller 9.

Reference is made to FIG. 2 for further description of the mechanism. FIG. 2 views the mechanism from the right of FIG. 1. Hinge 19 receives one end of coil spring 31. The opposite end of spring 31 is held in an extension 11*a* of link 11. Spring 31 has a coil portion and an extended tang 31*a* which is hooked into hinge 19. Spring 31 is stretched between hinge 19 and extension 11*a* and passes above pin 21. A link 33 is rotatably attached to hinge 19 above spring 31 in the position of FIG. 2. However, in the position of FIG. 2 link 33 does not apply force to link 11 as will be explained.

Accordingly, spring 31 is effective to apply a counterclockwise moment with respect to FIG. 2 around pivot point 15. This brings the left side of link 11 downward to bring charge roller 9 (as best seen in FIG. 1) into contact with photoconductor drum 5. The location of spring 31 above pivot point 21 also provides an upward bias on door 3.

Also shown in FIG. 2 is shutter 7, having a pivot hinge 37 on the cartridge (not shown) which contains photoconductor 5. Shutter 7 has an extension or stud 39 on the side shown and a similar extension on the opposite side of shutter 7 (not shown) positioned to engage the end 11*b* of link 11, with the similar extension positioned to engage the end of link 13. Shutters are conventionally used to protect the photoconductor from light and are conventionally opened by some physical interaction of installation. In this embodiment shutter 7 has a bias from a spring which forces extension 39 toward link end 11*b*. Links 11 and 13 hold shutter 7 open. However, since the force of shutter 7 is directed toward pivot points 15 and 17 (FIG. 1), it will not significantly affect the moment around pivot points 15 and 17.

Figure 3:
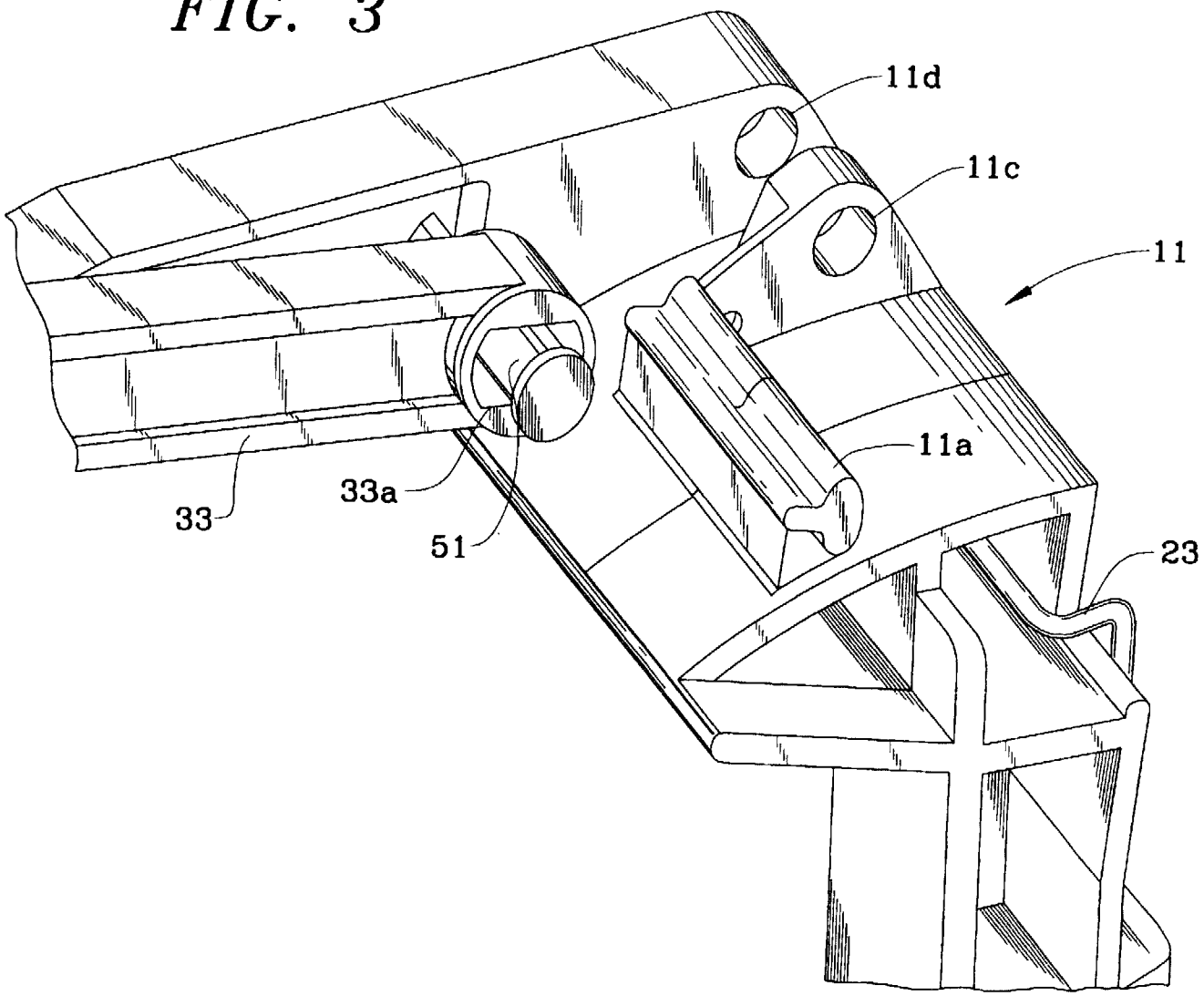
FIG. 3 is a detail illustrating a loose connection employed.

Reference is made to FIG. 3 to illustrate the loose connection of link 33 with link 11. FIG. 3 shows link 33 spaced leftward from its operative position for purposes of illustration. The end of link 33 which connects to link 11 has an elongated slot 33*a* which receives a pin 51 which is a vertical fit to slot 33*a*, but allows lateral movement in slot 33*a*. In actual installation, slot 33*a* is positioned between holes 11*c* and 11*d* of link 11 and pin 51 passes through hole 11*c*, slot 33*a* and then hole 11*d*. The length of link 33 and its point of connection with hinge 19 (FIG. 1) are dimensioned so that when link 11 is in the position of FIG. 2, when the door 3 is down, pin 51 does not contact either lateral side of slot 33*a*.

Figure 4:
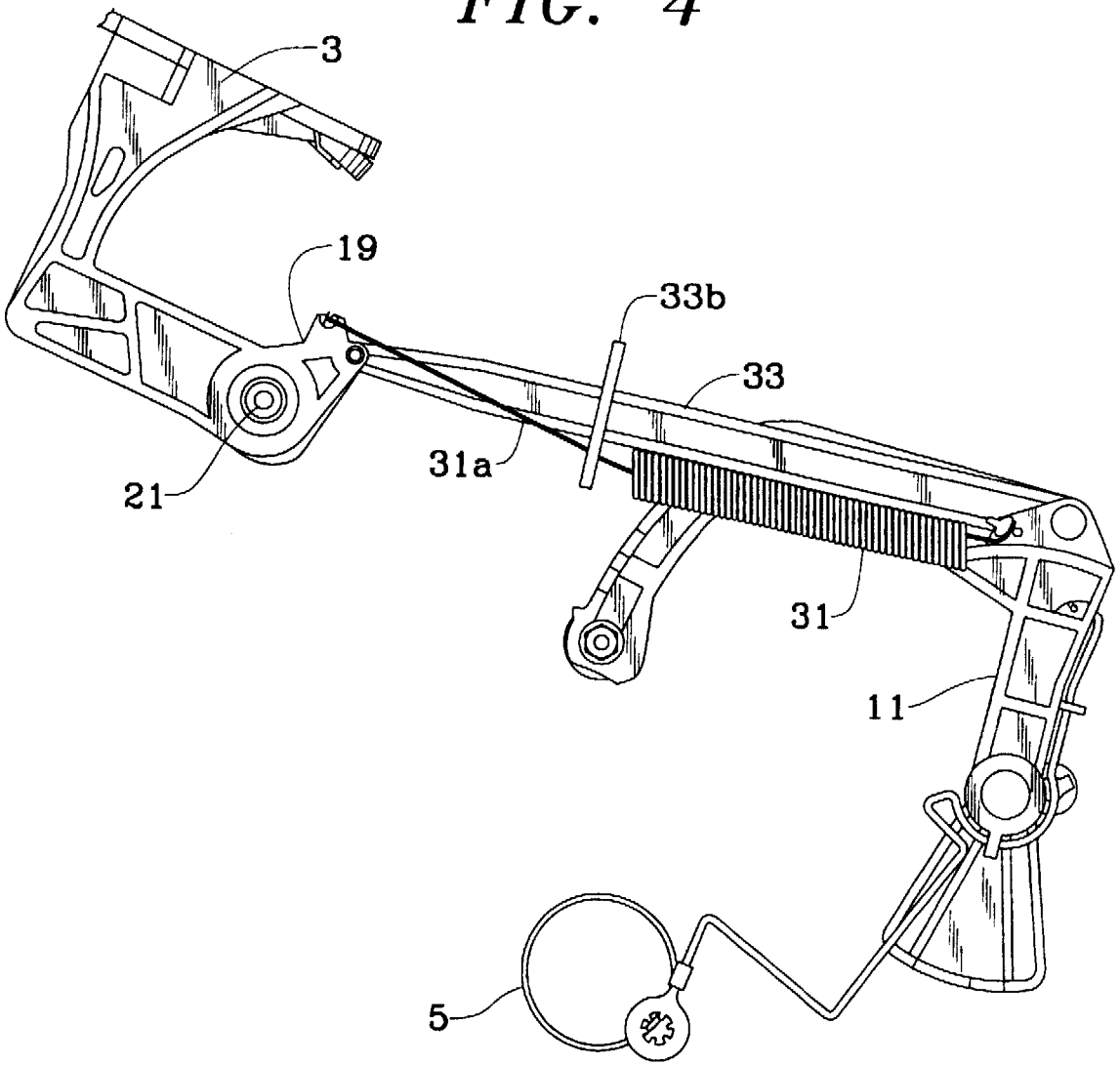
FIG. 4 is a side view from the right of FIG. 1 with the printer door open.

When in the FIG. 1 position, door 3 is latched down, as is conventional. An operator of printer 1 will pull door 3 upward, which typically is by applying sufficient force to overcome a resilient latch (not shown). Spring 31 and the substantially identical spring 32 attached to link 13 provide an upward force to give a "pop-up" response to unlatching door 3. The operator may push door 3 upward, but the force of springs 31 and 32 (and an auxiliary spring [not shown] between the door and the frame) are sufficient force to move the mechanism clockwise with respect to FIG. 4, to the position shown in FIG. 4. As hinge 19 rotates, at an early point in that movement the left side of slot 33*a* moves into contact with the pin 51. (This is true also for the mechanism attached to link 13, which is to be understood as a mirror image and otherwise substantially identical to the elements described with respect to FIG. 2, FIG. 3 and FIG. 4 except where specifically noted otherwise.) As hinge 19 rotates, link 33 then applies force on pin 51 in a direction to move link 11 clockwise. The tang of spring 31 encounters a guide member 33*b* which is integral to arm 33 so as to prevent it from interfering with an item in the printer not relevant to this invention. (As shown in FIG. 1 a similar guide member 33*bb*, reversed vertically, is on the other side. However, that is not functional at all and is employed so the link 33 and the counterpart link associated with link 13 can be manufactured as the same part. Similarly, spring 32 is attached to link 13 through a hole in an extension of link 13 located on the linear path of spring 32.)

To close the door 3 the operator pushes down on door 3 sufficiently to overcome the force of springs 31 and 32 and return the mechanism to the status shown in FIG. 2.

Figure 5:
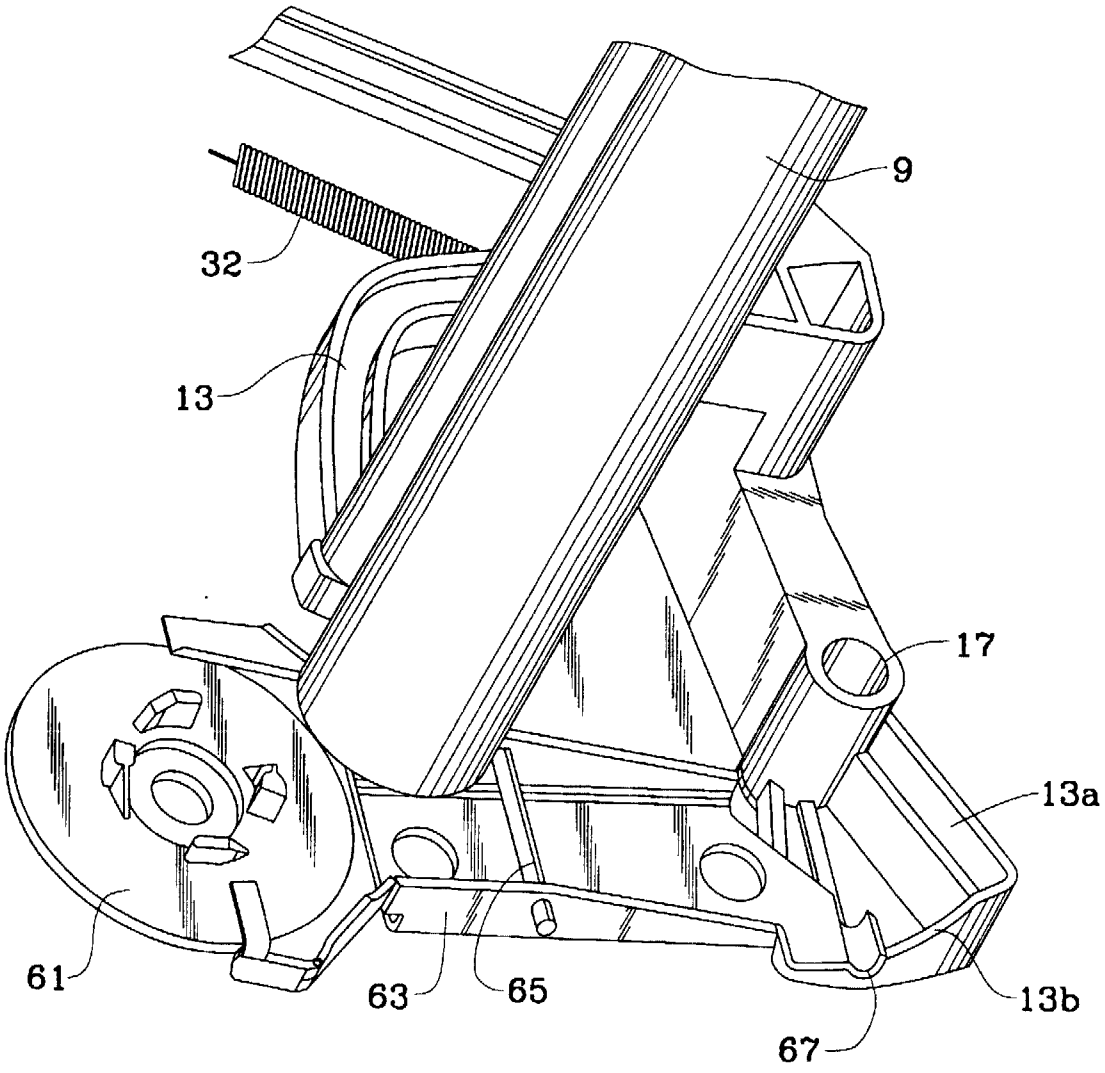
FIG. 5 is a detail illustrating the control of a coupler.

FIG. 5 shows the versatility of this mechanism. Link 13 has a lower extension 13*a* which has a cam face 13*b*. Mounted in the printer 1 is drive coupler 61 to apply torque to the elements in the installed cartridge containing photoconductor drum 5. The position of coupler 61 is controlled by bracket 63 which is pivoted on a pin 65. Bracket 63 is spring biased (spring not shown) to move coupler 61 outward. The end of bracket 63 opposite coupler 61 has a follower arm 67 positioned to contact cam face 13*b*.

When door 3 is closed, as previously described, link 13 rotates counterclockwise about pivot 17. This permits follower 67 to move outward and coupler 61 to move inward toward an installed cartridge under its spring bias. Conversely, when door 3 is opened, cam 13*b* moves clockwise and forces coupler 61 outward, which permits a cartridge to be removed without interference with coupler 61. Other attachments to this mechanism are a wire (not shown) to open fuser nip roller when door 3 is open, which makes the mechanism ready to remove a paper jam. Also, a spring (not shown) on the inside of door 3 which presses down on the cartridge containing drum 5 when door 3 is closed. Additionally, spring 31 is held on the outside of extension 11*a*, which provides some force leftward in FIG. 1; which force locates charge roller 9 by causing movement of charge roller 9 on links 11 and 13 until surface (not shown) on the outside of the cartridge containing drum 5.

Other variations and modifications will be apparent or may be anticipated.

We claim:

1. A door controlled mechanism comprising an imaging machine having a frame and a door rotatable upward for access to the inside of said imaging machine, a first link carrying a charging device to contact a member to be charged in said imaging machine upon closing of said door, said first link being rotatably connected to said frame within said imaging machine, a second link connected to said first link at a first end by an elongated slot having a side toward said door, a pin narrower than the length of said slot extending through said first link and said elongated slot, said second link having a second end spaced from said first end of said second link, said door being rotatably connected to said frame and rotatably connected to said second end of said second link, and a resilient member connected at a first end to said first link at a location spaced from the location at which said first link is rotatably connected to said frame, said resilient member having a second end opposite said first end of said resilient member connected to said door at a location a distance above said location of said rotatable connection of said door to said frame when said door is closed, to pivot said first link to move said contact member into contact with said member to be charged when said door is closed, said pin being located in the said elongated slot so as not to apply force to said side of said elongated slot when said door is closed, said second end of said second link being located above the location at which said door is rotatably connected to said frame when said door is closed so that upward movement which opens said door brings said second end of said second link toward said pin, said elongated slot being of size such that said movement of said second link toward said pin causes said pin to contact said first side of said elongated slot, said contact applying force from said resilient member to move said contact member away from contact with said member to be charged.

2. The mechanism of claim 1 in which said first link is a single element which is roughly in the shape of a capital letter U.

* * * * *